US008298735B2

(12) United States Patent
Kurachi et al.

(10) Patent No.: US 8,298,735 B2
(45) **Date of Patent: *Oct. 30, 2012**

(54) ORGANIC PHOTORECEPTOR AND MANUFACTURING METHOD THEREOF

(75) Inventors: Masahiko Kurachi, Tokyo (JP); Takeshi Ishida, Tokyo (JP); Toshiyuki Fujita, Tokyo (JP); Seisuke Maeda, Tokyo (JP); Seijiro Takahashi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 175 days.

This patent is subject to a terminal disclaimer.

(21) Appl. No.: 12/853,917

(22) Filed: Aug. 10, 2010

(65) Prior Publication Data

US 2011/0045393 A1 Feb. 24, 2011

(30) Foreign Application Priority Data

Aug. 19, 2009 (JP) ..... 2009-189836

(51) Int. Cl.
*G03G 5/00* (2006.01)

(52) U.S. Cl. ..... 430/66; 430/132

(58) Field of Classification Search ..... 430/66, 430/132

See application file for complete search history.

(56) References Cited

U.S. PATENT DOCUMENTS

2006/0160002 A1 * 7/2006 Qi et al. ..... 430/58.2

FOREIGN PATENT DOCUMENTS

| | | |
|---|---|---|
| JP | 6118681 | 4/1994 |
| JP | 2001125297 | 5/2001 |
| JP | 200398712 | 4/2003 |

* cited by examiner

*Primary Examiner* — Mark A Chapman
(74) *Attorney, Agent, or Firm* — Lucas & Mercanti, LLP

(57) ABSTRACT

Disclosed is an organic photoreceptor, which is composed of a photosensitive layer and a protective layer, provided on an electric conductive support, and the protective layer contains a composition obtained by hardening reaction of γ-alumina particles treated with a compound having a reactive functional group with a hardenable compound. A manufacturing method thereof is also disclosed.

19 Claims, 3 Drawing Sheets

ORGANIC PHOTORECEPTOR AND MANUFACTURING METHOD THEREOF

This application is based on Japanese Patent Application No. 2009-189836 filed on Aug. 19, 2009, in Japanese Patent Office, the entire content of which is hereby incorporated by reference.

FIELD OF THE INVENTION

The present invention directs to an organic photoreceptor used in the field of an image forming apparatus and manufacturing method of the organic photoreceptor.

BACKGROUND

An organic photoreceptor containing an organic photoconductive material is most widely employed in the electrophotography. While the organic photoreceptor has such advantages that it is easy to develop materials corresponding to various exposing light source from visible to infrared light, materials without environmental contamination can be selected, and manufacturing cost is low, in comparison with the other photoreceptor, there is a problem that mechanical strength is weak and it is liable to generate deterioration or damage on a surface of the photoreceptor during a plenty sheets of copying or printing.

It has been strongly demanded to reduce an abrasion due to scraping by cleaning blade etc., so as to improve the durability of the organic photoreceptor. For this purpose technology to provide a protecting layer with high mechanical strength on the photoreceptor has been tried. For example, the patent document No. 1 reports that colloidal silica containing hardenable siloxane resin is used for the protective layer of the photoreceptor. The colloidal silica containing hardenable siloxane resin has high moisture absorbing characteristics both in hardenable resin having siloxane bond (Si—O—Si bond) and colloidal silica, and therefore, electric resistivity of the protective layer is liable to lower and causing image blur or image flow.

The other patent document No. 2 reports a protective layer composed of hardenable resin obtained by photo polymerizing a compound having acryloyl group etc., for the hardenable resin applied to the protective layer. Though fillers such as metal oxide are incorporated in the protective layer, bonding between the filler and the hardenable resin is weak, mechanical strength required to the protective layer is insufficient, and the problems of image blur or image flow is not dissolved sufficiently.

Patent document No. 3 discloses that trigonal α-alumina particles as a filler to incorporate in the protective layer are effective to improve an image blur. However, the bonding between the alumina particles and the hardenable resin is weak in the protective layer by this method, the alumina particles is not dispersed uniformly in the protective layer sufficiently, strength of the protective layer is not is insufficient, and cleaning deficiency is apt to occur.

Prior Art Reference

Patent document No. 1: JP-A H06-118681
Patent document No. 2: JP-A 2001-125297
Patent document No. 3: JP-A 2003-098712

SUMMARY OF THE INVENTION

The object according to this invention is to dissolve the above mentioned problems, so as to improve an anti-abrasion property of the photoreceptor up to the same level as an amorphous silicone photoreceptor, to improve the image blur and image flow problem liable to generate in high temperature and high moisture condition, and to provide a high durable organic photoreceptor capable of obtaining a high quality electrophotographic image. The other object is to provide a manufacturing method of an organic photoreceptor, an image forming apparatus and process cartridge both employing the organic photoreceptor.

The protective layer of the organic photoreceptor has been examined, and anti-abrasion property and image blur and image flow problem in the high temperature and high moisture condition are found to dissolve, by that the protective layer has a structure of strong bonding filler mutually or between the filler and hardenable resin in the hardenable resin as well as the hardenable resin is hydrophobic in the protective layer. The present invention is attained by the following photoreceptor.

The organic photoreceptor according to this invention comprises, provided on an electric conductive support, a photosensitive layer and a protective layer, wherein the protective layer comprises a composition obtained by hardening reaction of γ-alumina particles treated with a compound having a reactive functional group with a hardenable compound.

Preferable example of the compound having a reactive functional group is a compound having a carbon-carbon double bond and silyl group.

Preferable example of the hardenable compound is a compound having a carbon-carbon double bond.

Preferable example of the hardenable compound is a compound having an acryloyl or methacryloyl group.

The number based 50% particle diameter of the γ-alumina particles is preferably 5 to 200 nm. The image forming apparatus comprises a charging unit, an exposing unit and developing unit around an organic photoreceptor, wherein the above described organic photoreceptor is employed.

The process cartridge used for the image forming apparatus comprises the organic photoreceptor described above, and at least one of a charging unit, exposing unit and a developing unit integrally, wherein the process cartridge is detachable from main frame of the image forming apparatus.

The organic photoreceptor can be manufactured by a method wherein the protective layer is formed by steps comprising; surface treating γ-alumina particles with a compound having a reactive functional group, preparing a coating composition comprising the treated γ-alumina particles and a hardenable compound, coating the coating composition on the photosensitive layer, and hardening the coated composition.

ADVANTAGE OF THE INVENTION

Strength of surface of the photoreceptor against abrasion and scratches is improved remarkably, and surface durability and wastage thickness are improved, occurrence of black spots, as well as mage blur under ambience of high temperature and high moisture are improved markedly by the photoreceptor according to this invention.

DESCRIPTION OF THE INVENTION

Figure 1:
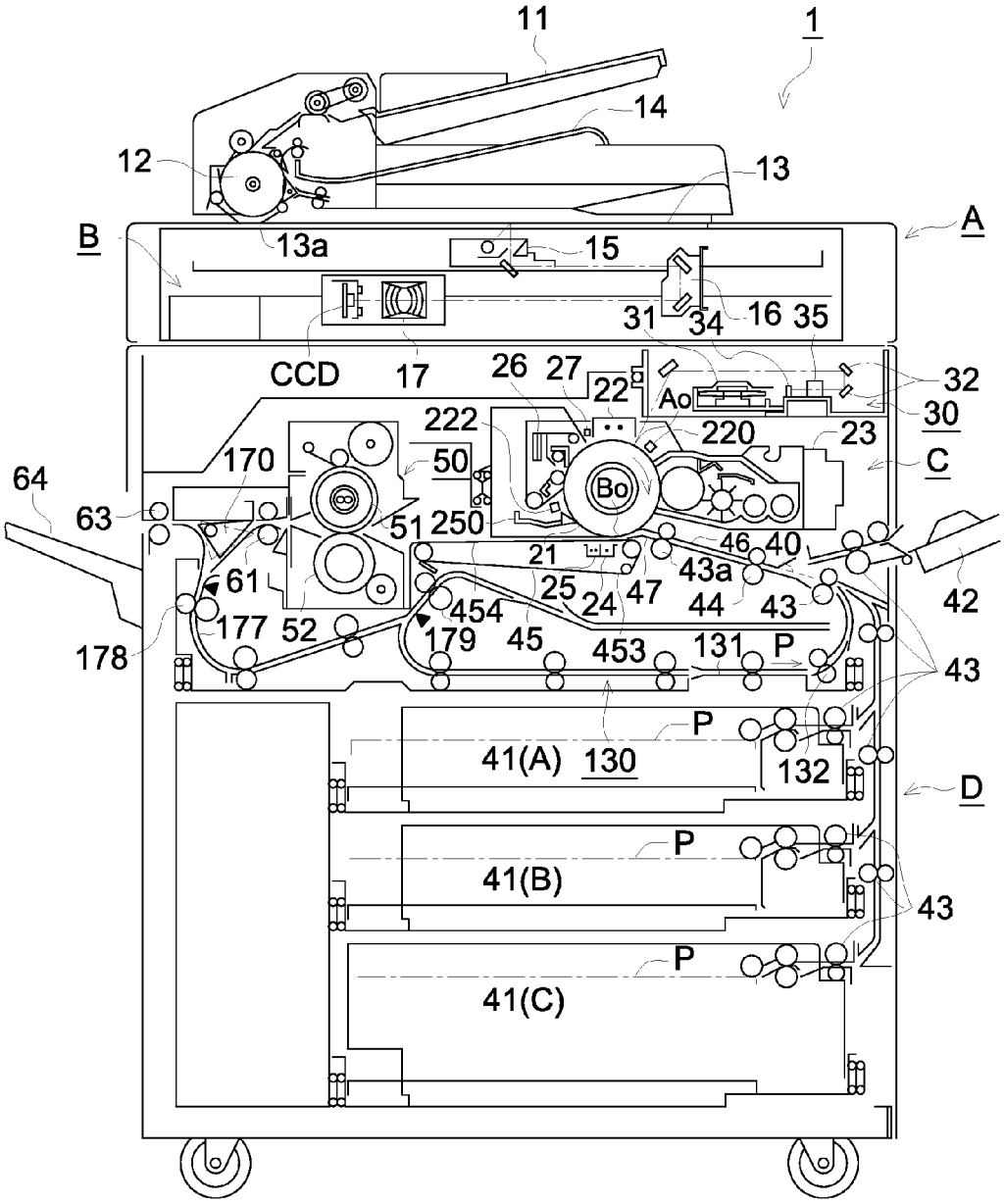
FIG. 1: A schematic view of an image forming apparatus in which the photoreceptor of the present invention is applied.

The organic photoreceptor comprises, provided on an electric conductive support, a photosensitive layer and a protective layer, wherein the protective layer comprises a composition obtained by hardening reaction of γ-alumina particles treated with a compound having a reactive functional group with a hardenable compound.

The γ-alumina particles treated with a compound having a reactive functional group will be described.

The γ-alumina particles treated with a compound having a reactive functional group can be obtained by treating the γ-alumina particles treated with a silane compound having a reactive functional group, and so on.

For example, a compound represented by Formula (1) is used.

Formula (1)

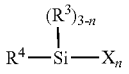

In the formula $R^3$ is an alkyl having carbon atoms of from 1 to 10 or an aralkyl having carbon atoms of from 1 to 10, $R^4$ is an organic group having polymerizable double bond, X is a halogen atom, an alkoxy, acyloxy, aminooxy or phenoxy group, n is an integer of from 1 to 3.

The silane compounds to react with the alumina particles are not limited to the compounds represented by the Formula (1) as far as the compound has a silyl group, in particular, a silyl group capable of hydrolysis, and thereafter capable of radical polymerization. Examples of compounds represented by the Formula (1) are listed below.

S-1 $CH_2{=}CHSi(CH_3)(OCH_3)_2$
S-2 $CH_2{=}CHSi(OCH_3)_3$
S-3 $CH_2{=}CHSiCl_3$
S-4 $CH_2{=}CHCOO(CH_2)_2Si(CH_3)(OCH_3)_2$
S-5 $CH_2{=}CHCOO(CH_2)_2Si(OCH_3)_3$
S-6 $CH_2{=}CHCOO(CH_2)_3Si(CH_3)(OCH_3)_2$
S-7 $CH_2{=}CHCOO(CH_2)_3Si(OCH_3)_3$
S-8 $CH_2{=}CHCOO(CH_2)_2Si(CH_3)Cl_2$
S-9 $CH_2{=}CHCOO(CH_2)_2SiCl_3$
S-10 $CH_2{=}CHCOO(CH_2)_3Si(CH_3)Cl_2$
S-11 $CH_2{=}CHCOO(CH_2)_3SiCl_3$
S-12 $CH_2{=}C(CH_3)COO(CH_2)_2Si(CH_3)(OCH_3)_2$
S-13 $CH_2{=}C(CH_3)COO(CH_2)_2Si(OCH_3)_3$
S-14 $CH_2{=}C(CH_3)COO(CH_2)_3Si(CH_3)(OCH_3)_2$
S-15 $CH_2{=}C(CH_3)COO(CH_2)_3Si(OCH_3)_3$
S-16 $CH_2{=}C(CH_3)COO(CH_2)_2Si(CH_3)Cl_2$
S-17 $CH_2{=}C(CH_3)COO(CH_2)_2SiCl_3$
S-18 $CH_2{=}C(CH_3)COO(CH_2)_3Si(CH_3)Cl_2$
S-19 $CH_2{=}C(CH_3)COO(CH_2)_3SiCl_3$
S-20 $CH_2{=}CHSi(C_2H_5)(OCH_3)_2$
S-21 $CH_2{=}C(CH_3)Si(OCH_3)_3$
S-22 $CH_2{=}C(CH_3)Si(OC_2H_5)_3$
S-23 $CH_2{=}CHSi(OCH_3)_3$
S-24 $CH_2{=}C(CH_3)Si(CH_3)(OCH_3)_2$
S-25 $CH_2{=}CHSi(CH_3)Cl_2$
S-26 $CH_2{=}CHCOOSi(OCH_3)_3$
S-27 $CH_2{=}CHCOOSi(OC_2H_5)_3$
S-28 $CH_2{=}C(CH_3)COOSi(OCH_3)_3$
S-29 $CH_2{=}C(CH_3)COOSi(OC_2H_5)_3$
S-30 $CH_2{=}C(CH_3)COO(CH_2)_3Si(OC_2H_5)_3$
S-31 $CH_2{=}CHCOO(CH_2)_2Si(CH_3)_2(OCH_3)$
S-32 $CH_2{=}CHCOO(CH_2)_2Si(CH_3)(OCOCH_3)_2$
S-33 $CH_2{=}CHCOO(CH_2)_2Si(CH_3)(ONHCH_3)_2$
S-34 $CH_2{=}CHCOO(CH_2)_2Si(CH_3)(OC_6H_5)_2$
S-35 $CH_2{=}CHCOO(CH_2)_2Si(C_{10}H_{21})(OCH_3)_2$
S-36 $CH_2{=}CHCOO(CH_2)_2Si(CH_2C_6H_5)(OCH_3)_2$

S-37

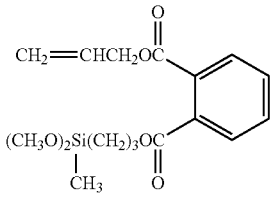

S-38

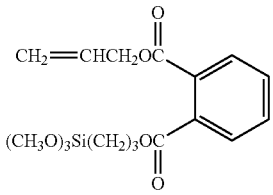

S-39

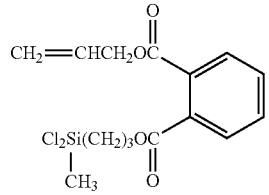

S-40

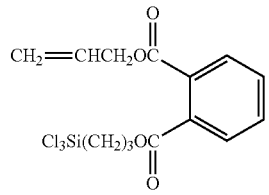

The silane compounds may be used singly or by mixing two or more.

Preparation Method of γ-Alumina Particles Having Reactive Organic Group

The γ-alumina particles having a reactive organic group can be obtained by surface treatment of the γ-alumina particles with a silane compound. The silane compound of 0.1 to 100 parts by weight as the surface treating agent and a solvent of 50 to 5,000 parts by weight are used for 100 parts by weight of γ-alumina particles by employing wet type medium dispersion apparatus for the surface treatment.

A surface treatment method is described to produce γ-alumina particles uniformly and minutely surface treated with a silane compound.

The γ-alumina particles are pulverized into particles, and simultaneously, surface treatment of the γ-alumina particles is progressed by pulverizing in wet method wherein slurry containing γ-alumina particle and silane compound surface treating agent (suspension of solid particles). After that particulates are formed by removing solvent, γ-alumina particles surface of which is treated with uniform and minute silane compound can be obtained.

A wet type medium dispersion apparatus used for the surface treatment comprises a container filled with beads as medium, and it crushes aggregation of metal oxide particles to pulverizes and disperse by rotating stirring disk arranged perpendicular to rotation shaft with high speed. Various type of apparatus such as longitudinal or horizontal, continuous or batch type, may be employed as far as it disperses the metal oxide particles and capable of surface treating. Practical examples include sand mill, ultravisco mill, pearl mill, grain mill, DYNO-MILL, agitator mill, and dynamic mill. The dispersion apparatus employs pulverizing medium such as balls and beads, to make fine pulverizing and dispersing via impact pressure crushing, friction, shearing, shearing stress and so on.

Beads applicable to sand grinder include balls made of glass, alumina, zircon, zirconia, steal, flint stone, and zircon or zirconia beads are preferable. Beads having particle diameter of 0.3 to 1.0 mm are preferably used in this invention though those having particle diameter of 1 to 2 mm are used usually.

Various materials such as stainless steal, nylon, ceramics may be used for a disk or inner wall of the wet type medium dispersion apparatus in general, disk or inner wall made by ceramics such as zirconia or silicone carbide are particularly preferable.

The γ-alumina particles having a reactive organic group can be obtained by surface treatment employing silane compound of Formula (1) etc., via the wet processing described above.

The γ-alumina particles having a reactive organic group can form a protective layer by a reaction with a hardenable compound.

γ-Alumina

The γ-alumina used in this invention includes not only a γ-alumina in the strict meaning but also a substantial γ-alumina. The substantial γ-alumina means alumina containing γ-alumina as a primary crystal structure, even the alumina contains other crystal structure as δ- or θ-alumina.

Analysis of Alumina Crystal Structure

The γ-alumina is specified by peak intensity analysis via an X ray diffraction apparatus MINIFLEX (product by Rigaku Corp.).

The γ-alumina used in this invention can be manufactured via a thermal plasma method by employing an arc discharge plasma generator etc., as described in JP A H11-278828. For example, γ-alumina can be obtained by a method in which arc discharge is conducted between a counter electrode and an electrode while inert gas is aligned to the electrode, using an aluminum metal as one of the electrode material, whereby aluminum is made vapor of plasma stream, and then aluminum in plasma state is reacted with oxygen containing gas. The γ-alumina obtained in such way may change to δ- or θ-alumina by, for example, thermal treatment thereafter. The substantial γ-alumina according to this invention as described before includes γ-alumina including small amount of δ- or θ-alumina.

The γ-alumina appears crystal structures of cubic crystal and a mix crystal of cubic and rhombic crystal, cubic and hexagonal crystal, by a classification via X ray diffraction analysis and so on, since it includes pure γ-alumina in a strict means as well as substantial γ-alumina including δ- or θ-alumina.

The γ-alumina used in this invention has larger specific surface area than, for example, α-alumina, it is excellent in reaction performance of surface treatment with a silane compound of Formula (1) etc., and the silane compound bonds to firmly at the alumina surface to obtain γ-alumina particles having a reactive functional group. The γ-alumina particles are incorporated in the hardenable resin formed by a reaction with a hardenable compound as a part of the resin structure in the protective layer.

Particle Diameter of γ-Alumina

A number based 50% particle diameter of the γ-alumina particles is preferably 5-3200 nm, and more preferably 10-100 nm. Anti-abrasion property is not sufficient in case of smaller particle diameter, and there may be possibility that exposure light may be scattered or anti-abrasion property becomes insufficient as the particles inhibit photo-curing.

The number average primary particle diameter of the γ-alumina particles is obtained by a method in which photograph of magnification factor of 10,000 times is taken via scanning electro-microscopy (manufactured by JEOL Ltd.) and randomly selected 300 particles, excluding aggregated particles, are read in by a scanner. Number average particle diameter is calculated by an automatic image processor LUZEX AP, manufactured by Nireco Corporation, with software ver. 1.32.

The γ-alumina used in this invention can be obtained by a manufacturer specialized in this matter.

Content of the γ-alumina particles in the protective layer is preferably 1 to 300 parts by weight, and more preferably 80-200 parts by weight with reference to 100 parts by weight of the hardenable compound.

The γ-alumina particles having a reactive organic group can form a protective layer by a reaction with a hardenable compound.

The hardenable compound which reacts with γ-alumina particles having a reactive organic group includes various compounds having a carbon-carbon double bond.

The hardenable compound is preferably a monomer to form resins used generally binder resin of the photoreceptor via polymerization caused by actinic ray irradiation such as ultraviolet ray and electron beam, or thermal polymerization, and preferable examples include a styrene type monomer, an acryl type monomer, a methacryl type monomer, a vinyl toluene type monomer, vinyl acetate type monomer and N-vinyl pyrrolidone type monomer.

The hardenable compounds having an acryloyl or methacryloyl group are particularly preferable because they are capable of hardened with small amount of light in a short time. Most preferable is a compound having a methacryloyl group.

The hardenable compounds may be used independently or mixing with two or more different type compounds.

Examples of the hardenable compounds are listed.

Acrylic compounds include compounds having either an acryloyl group ($CH_2{=}CHCO{-}$) or a methacryloyl group ($CH_2{=}CCH_3CO{-}$). Further, number of Ac groups (number of acryloyl groups), as described herein, refers to the number of acryloyl or methacryloyl groups.

| No. | | Ac Number |
|---|---|---|
| (1) | 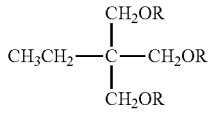 | 3 |

-continued
| No. | | Ac Number |
|---|---|---|
| (2) | 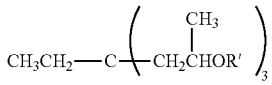 | 3 |
| (3) | 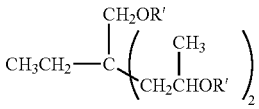 | 3 |
| (4) | 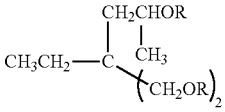 | 3 |
| (5) | 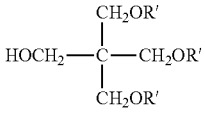 | 3 |
| (6) | 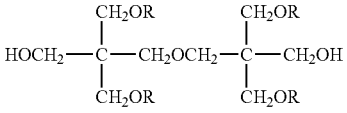 | 4 |
| (7) | 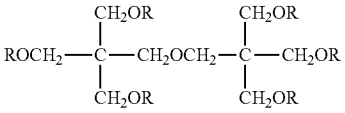 | 6 |
| (8) | 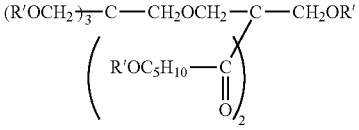 | 6 |
| (9) | 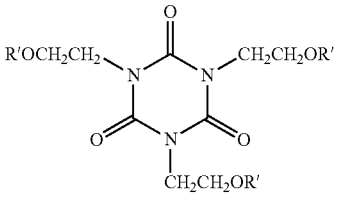 | 3 |
| (10) | $CH_3CH_2C(CH_2OC_3H_6OR)_3$ | 3 |
| (11) | 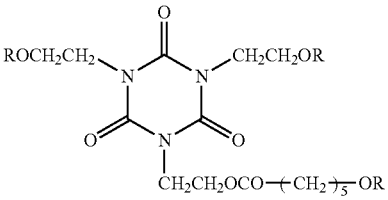 | 3 |
| (12) | $(ROCH_2)_3C—O—C(CH_2OR)_3$ | 6 |
| (13) | $(ROCH_2)_3C—CH_2OCH_2—C(H)(CH_2OR)_2$ | 5 |
| (14) | $(ROCH_2)_3C—CH_2OCH_2—C(CH_3)(CH_2OR)_2$ | 5 |

-continued
| No. | | Ac Number |
|---|---|---|
| (15) | $(ROCH_2)_3C—CH_2OCH_2—C(CH_2OR)_2$ <br> $CH_2OH$ | 5 |
| (16) | $(R'OCH_2)_3C—CH_2OCH_2—C(CH_2OH)_2$ <br> $CH_2OR'$ | 4 |
| (17) | $(ROCH_2)_3C—O—C(CH_2OR)_2$ <br> $CH_2OH$ | 5 |
| (18) | 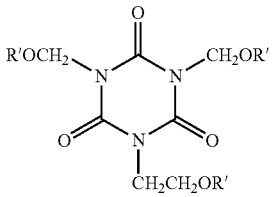 | 3 |
| (19) | $CH_3CH_2—C(CH_2CH_2OR)_3$ | 3 |
| (20) | $HOCH_2—C\left(CH_2O—C(=O)CH_2CH_2CH_2CH_2CH_2OR\right)_3$ | 3 |
| (21) | 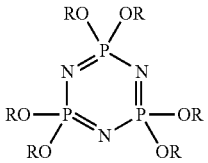 | 6 |
| (22) | 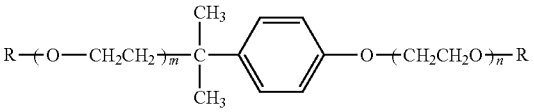 | 2 |
| (23) | 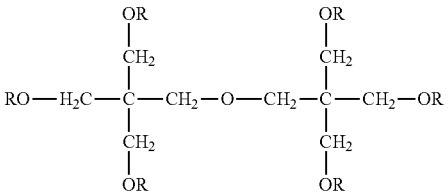 | 6 |
| (24) | 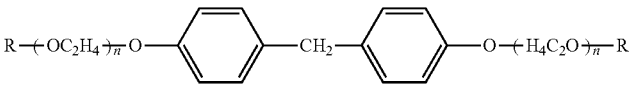 <br> $(n \approx 2)$ | 2 |
| (25) | 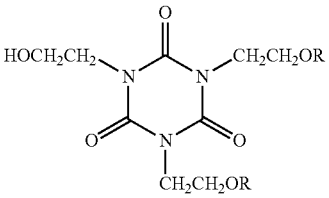 | 2 |
| (26) | $R—(OC_3H_6)_3—OR$ | 2 |

-continued
| No. | | Ac Number |
|---|---|---|
| (27) | 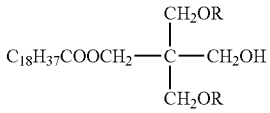 | 2 |
| (28) | 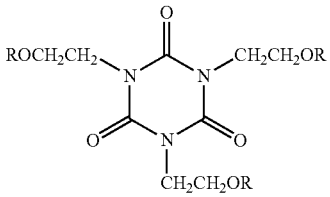 | 3 |
| (29) | 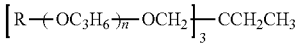 (n ≈ 3) | 3 |
| (30) | 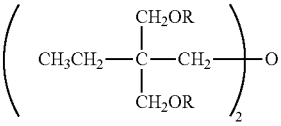 | 4 |
| (31) | 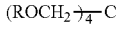 | 4 |
| 32 | 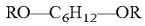 | 2 |
| 33 | 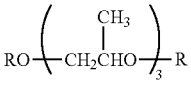 | 2 |
| 34 | 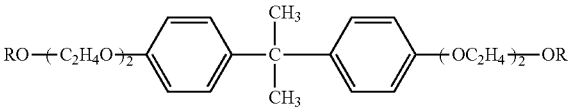 | 2 |
| 35 | 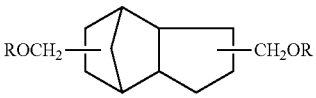 | 2 |
| 36 | 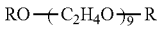 | 2 |
| 37 | 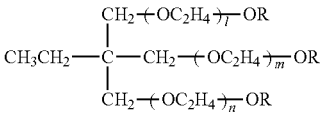 (l + m + n = 3) | 3 |
| 38 | 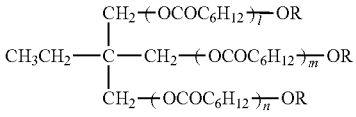 (l + m + n = 3) | 3 |

-continued

| No. | | Ac Number |
|---|---|---|
| 39 | mixture of 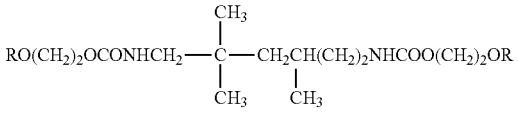 and 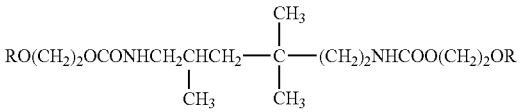 | 2 |
| 40 | $(ROCH_2)_3CCH_2OCONH(CH_2)_6NHCOOCH_2C(CH_2OR)_3$ | 2 |
| 41 | 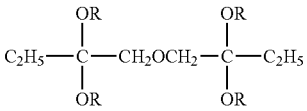 | 4 |
| 42 | 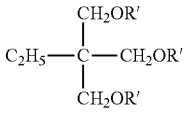 | 3 |
| 43 | 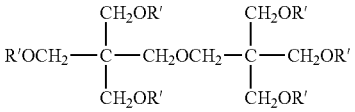 | 6 |
| 44 | 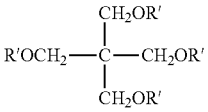 | 4 |

In the above formulae, R and R' are each as follows:

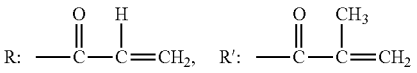

The hardenable compounds preferably have two or more functional groups, (groups having a carbon-carbon double bond) and more preferably four or more functional groups in particular. The number of functional groups is shown as Ac number in the above illustrated compounds. The compounds having Ac number of two or more is preferable and particularly preferable four to six. It is preferred that a hardenable reactive functional equivalent, i.e., a ratio of M/Ac has preferably 1,000 or less, and more preferably 500 or less, wherein Ac and M are a number of acryloyl or methacryloyl groups and molecular weight, respectively, of the compound having a acryloyl or methacryloyl group when the hardenable compound is an acryl type compound. High crosslinking density is obtained and improved anti-abrasion property of the photoreceptor is obtained by satisfying the relation.

Two or more hardenable compounds having different Ac/M ratio, respectively may be used by mixture.

The protective layer may be formed by coating and subjecting hardening a coating composition containing a polymerization initiator, filler, a lubricant, and an anti-oxidant, in addition to the hardenable compound and alumina particles surface treated with a compound having a reactive functional group described above.

When the hardenable compound is reacted, a method reacting initiated electron beam cleavage, a method reacting by light or heat via adding radical polymerization initiator or cation polymerization initiator. A light polymerization initiator or a heat polymerization initiator may be employed. The light and heat polymerization initiators are employed in combination.

Preferable polymerization initiator is light polymerization initiator, particularly, alkylphenone type compounds or phosphine oxide type compounds as the polymerization initiator of the photo-hardenable compound. Preferably employed light polymerization initiator is exemplified.

Examples of α-Amino acetophenone Type Compounds:

Polymerization Initiator 1-1

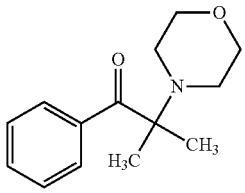

-continued

Polymerization Initiator 1-2

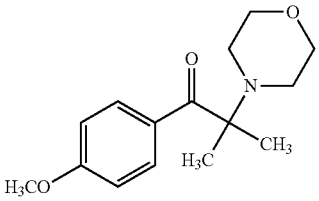

Polymerization Initiator 1-3

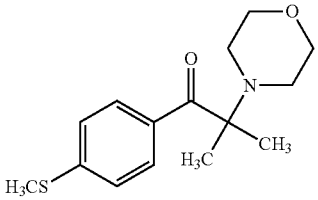

Polymerization Initiator 1-4

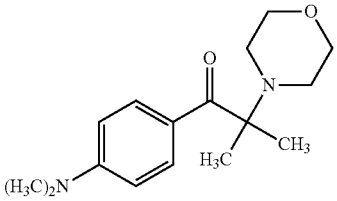

Polymerization Initiator 1-5

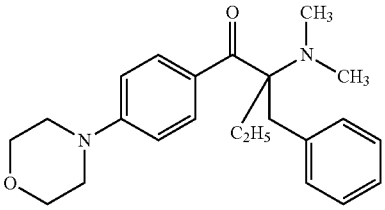

Polymerization Initiator 1-6

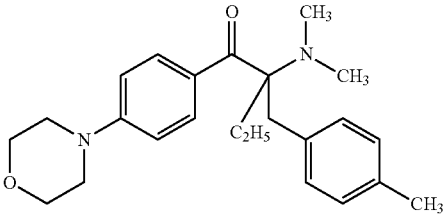

Examples of α-Hydroxy acetophenone Type Compounds:

Polymerization Initiator 2-1

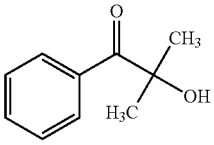

Polymerization Initiator 2-2

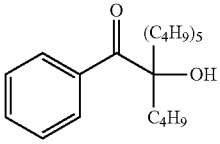

-continued

Polymerization Initiator 2-3

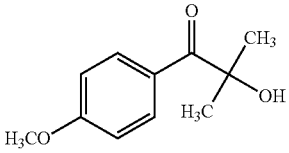

Polymerization Initiator 2-4

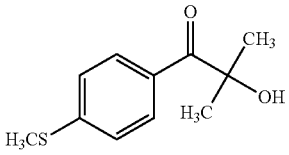

Polymerization Initiator 2-5

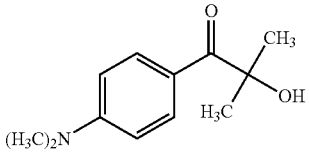

Polymerization Initiator 2-6

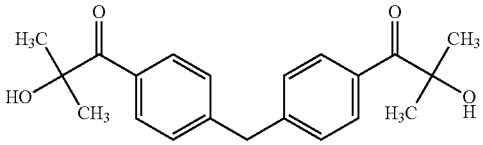

Examples of Acylphosphine Oxide Type Compounds:

Polymerization Initiator 3-1

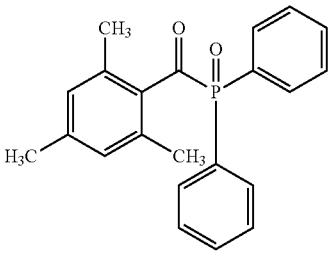

Polymerization Initiator 3-2

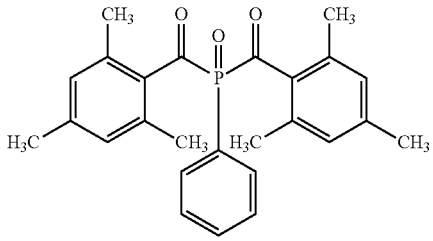

Examples of Other Radical Type Polymerization Initiator:

Polymerization Initiator 4-1

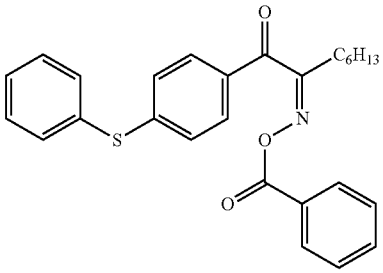

-continued

Polymerization Initiator 4-2

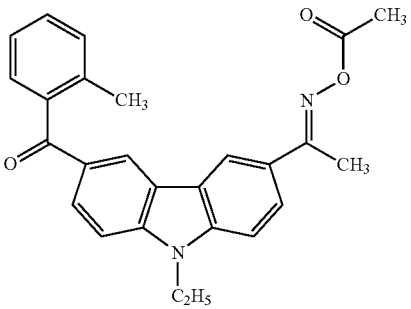

Polymerization Initiator 4-3

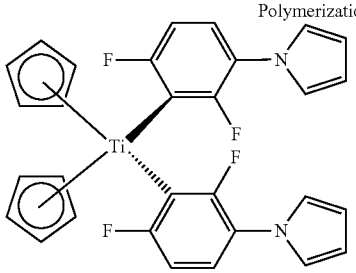

It is preferable that the a coating composition for the protective layer as describe above is applied on the photosensitive layer, then is dried primarily until the viscosity of coating layer disappears, then it is hardened by irradiating an actinic ray such as UV ray or applying heat, and further, is dried secondarily to make the content of the volatile component in the coated layer to stipulated amount.

Conventionally used UV ray irradiating apparatus can be used for hardening the UV ray hardenable resin.

An amount of the UV ray (mJ/cm$^2$) to harden resin is preferably controlled by UV ray irradiation intensity and irradiation time.

The thermal polymerization initiator includes a ketone-peroxide type compound, a peroxy ketal type compound, hydroperoxide type compound, dialkyl peroxide type compound, a diacyl peroxide type compound, a peroxy dicarbonate compound, peroxy ester type compound and so on are employed, and these thermal polymerization initiators are disclosed by the manufactures' catalogue, etc.

The thermal polymerization initiator is mixed with the γ-alumina particles treated with a compound having a reactive functional group or the hardenable compound to prepare coating composition for protective layer. After applying the coating composition on the photosensitive layer, it is subjected to drying by heat to form the protective layer according to this invention. The following thermal polymerization initiator is used in the manufacturing example of a hardened protective layer via thermal polymerization in the working example described later.

Polymerization Initiator 5-1

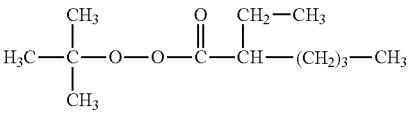

The coating method by the round shaped amount controlling coating means such as a round slide hopper are preferable for inhibiting dissolution of the photosensitive layer provided under the protective layer since coating by immersion in which the photoreceptor as a whole is immersed in the coating composition for forming a protective later and diffusion of polymerization initiator is increased. The use of the coating method by the round shaped amount controlling coating means is most preferable for coating of the protective layer. The coating method by the round shaped amount controlling coating means is described in detail in, for example, JP A S58-189061.

Two or more polymerization initiators may be used in mixture. The content of the polymerization initiator is 0.1 to 20 parts by weight, preferably 0.5 to 10 parts by weight with respect to 100 parts by weight of the acryl based compound.

Various charge transfer material may be further incorporated in the protective layer according to this invention.

Various lubricant particles may be incorporated in the protective layer used in this invention. Fluorine atom containing resin particles can be added for example. The fluorine atom containing resin is preferably one or more selected optionally from the an ethylene tetrafluoride resin, an ethylene trifluoride chloride, an ethylenepropylene hexafluoride chloride resin, a vinyl fluoride resin, a vinylidene fluoride resin, an ethylene difluoride dichloride resin, and more preferably is the ethylene tetrafluoride resin and the vinylidene fluoride resin. Content of the lubricant particles in the protective layer is preferably 5 to 70, more preferably 10 to 60 parts by weight with respect to 100 parts by weight of the acryl based resin. An average primary particle diameter of the lubricant particles is preferably 0.01 to 1 μm, and more preferably 0.05 to 0.5 μm. Molecular weight of the resin can be selected optionally without particular limitation.

The examples of the solvent for forming the protective layer include methanol, ethanol, n-propyl alcohol, isopropyl alcohol, n-butanol, sec-butanol, benzyl alcohol, toluene, xylene, methylene chloride, methyl ethyl ketone, cyclohexanone, ethyl acetate, butyl acetate, methyl cellosolve, ethyl cellosolve, tetrahydrofuran, 1-dioxane, 1,3-dioxolane, pyridine, and diethyl amine, without limitation.

The protective layer according to this invention is preferably formed by irradiating actinic ray to make reaction, after coating, and natural drying or thermal drying.

Similarly to the case of the intermediate layer or photosensitive layer, the protective layer can be coated according to such methods as dip coating, spray coating, spinner coating, bead coating, blade coating, beam coating, and slide hopper coating methods.

For the photoreceptor of the present invention, the following step is preferably used: Actinic radiation is applied to a coating layer to generate radicals and cause polymerization. Intermolecular and intramolecular crosslinking is formed by a crosslinking reaction, and curing is performed to generate a cured resin. It is preferred in particular to use an ultraviolet ray and electron beam as actinic radiation.

There is no particular restriction to the ultraviolet light source if ultraviolet rays can be emitted. It is possible to use a low pressure mercury lamp, intermediate pressure mercury lamp, high pressure mercury lamp, extra-high pressure mercury lamp, carbon arc lamp, metal halide lamp, xenon lamp, flash or pulse xenon and others. Irradiation conditions differ according to each lamp. The dose of actinic radiation is normally in the range of 5 to 500 mJ/cm$^2$, preferably in the range of 5 to 100 mJ/cm$^2$. The electric power of the lamp is preferably in the range of 0.1 kW through 5 kW, more preferably in the range of 0.5 kW through 3 kW.

There is no restriction to the electron beam irradiation apparatus as the electron beam source. Generally, a curtain beam type that produces high power at less costs is effectively used as an electron beam accelerator for emitting the electron beam. The acceleration voltage at the time of electron beam irradiation is preferably in the range of 100 through 300 kV. The absorbed dose is preferably kept in the range of 0.5 through 10 Mrad.

The irradiation time to get the required dose of actinic radiation is preferably 0.1 sec to 10 min., and is more preferably 0.1 sec to 5 min.

Ultraviolet rays are easy to use as actinic radiation, and are preferably used.

The protective layer of the photoreceptor can be dried before and during irradiation with actinic radiation. Appropriate timing for drying can be selected by a combination thereof.

Appropriate drying conditions can be selected according to the type of solvent and film thickness. The drying temperature is preferably from the room temperature to 180° C., more preferably from 80° C. to 140° C. Drying time is preferably 1 min to 200 min, more preferably 5 min to 100 min.

The film thickness of the protective layer is preferably in the range of 0.2 through 10 μm, more preferably in the range of 0.5 through 6 μm.

Conductive Support

There is no restriction to the support used in the present invention if it is conductive. The examples are: a drum or a sheet formed of such a metal as aluminum, copper, chromium, nickel, zinc and stainless steel; a plastic film laminated with such a metal foil as aluminum and copper; a plastic film provided with vapor deposition of aluminum, indium oxide, and tin oxide; and a metal, plastic film, or paper provided with a conductive layer by coating a conductive substance independently or in combination with a binder resin.

Intermediate Layer

An intermediate layer having a barrier function and adhesion function can be provided between the conductive layer and a photosensitive layer in the present invention.

To form the intermediate layer, such a binder resin as casein, polyvinyl alcohol, nitrocellulose, ethylene-acrylic acid copolymer, polyamide, polyurethane or gelatin is dissolved in the commonly known solvent, and the intermediate layer can be formed by dip coating. Of these materials, alcohol soluble polyamide resin is preferably used.

Various types of conductive fine particles and metallic oxides can be added to adjust the resistance of the intermediate layer. Examples are such metallic oxides as alumina, zinc oxide, γ-alumina, tin oxide, antimony oxide, indium oxide, and bismuth oxide. Examples also include extra-fine particles of tin-doped indium oxide, antimony-doped tin oxide, and antimony-doped zirconium oxide.

These metallic oxides each can be used independently or two or more of them can be used in combination. When two or more of them are used in combination, they can be used in the form of a solid solution or a fused substance. The preferred average particle size of such metallic oxide is preferably 0.3 μm or less, more preferably 0.1 μm or less.

The solvent used for preparation of the intermediate layer is preferably capable of effective dispersion of inorganic particles and dissolution of polyamide resin. The preferred solvent is exemplified by alcohols containing 2 through 4 carbon atoms such as ethanol, n-propyl alcohol, isopropyl alcohol, n-butanol, t-butanol, and sec-butanol having excellent polyamide resin dissolution and coating performances. Further, to improve the storage ability and particle dispersion, it is possible to use an auxiliary solvent providing excellent effects when used in combination with the aforementioned solvent. The examples of such an auxiliary solvent are methanol, benzyl alcohol, toluene, methylene chloride, cyclohexane, and tetrahydrofuran.

The concentration of the binder resin is selected as appropriate in conformity to the film thickness of the intermediate layer and production speed.

When inorganic particles are dispersed in the binder resin, the amount of the mixed inorganic resin is preferably in the range of 20 through 400 parts by weight, more preferably in the range of 50 through 200 parts by weight, with respect to 100 parts by weight of the binder resin.

An ultrasonic homogenizer, a ball mill, sand a grinder, and a homomixer can be used to disperse the inorganic particles.

The method of drying the intermediate layer can be selected as appropriate in conformity to the type of solvent and film thickness. The method of drying by heat is preferably used.

The film thickness of the intermediate layer is preferably 0.1 to 15 μm, more preferably 0.3 through 10 μm.

Electric Charge Generation Layer

The electric charge generation layer used in the present invention is preferably a layer that contains an electric charge generation material and a binder resin, and is formed by dispersing the electric charge generation material in the binder resin solution, and coating the same.

The electric charge generation material is exemplified by an azo material such as Sudan Red and Diane Blue; quinone pigment such as pyrene quinone and anthanthrone; quinocyanine pigment; perylene pigment; indigo pigment such as indigo, and thioindigo; and phthalocyanine pigment. These electric charge generation materials can be used independently or in the form dispersed in the resin.

The conventional resin can be used as the binder resin of the electric charge generation layer. Such a resin is exemplified by polystyrene resin, polyethylene resin, polypropylene resin, acryl resin, methacryl resin, vinyl chloride resin, vinyl acetate resin, polyvinyl butyral resin, epoxy resin, polyurethane resin, phenol resin, polyester resin, alkyd resin, polycarbonate resin, silicone resin, melamine resin, copolymer resin containing two or more of these resins (e.g., vinyl chloride-vinyl acetate copolymer, vinyl chloride-vinyl acetate-anhydrous maleic acid copolymer), and polyvinyl carbazole resin.

The electric charge generation layer is preferably formed as follows: The electric charge generation material is dispersed by a homogenizer into solution obtained by dissolving a binder resin in solvent, whereby a coating composition is prepared. Then the coating composition is coated to a predetermined thickness using a coating device. After that, the coated film is dried, whereby the electric charge generation layer is formed.

The examples of the solvent used for dissolving the binder resin used for preparing the electric charge generation layer and coating include toluene, xylene, methylene chloride, 1,2-dichloroethane, methyl ethyl ketone, cyclohexane, ethyl acetate, butyl acetate, methanol, ethanol, propanol, butanol, methyl cellosolve, ethyl cellosolve, tetrahydrofuran, 1-dioxane, 1,3-dioxolane, pyridine and diethyl amine.

An ultrasonic homogenizer, ball mill, sand grinder, and homomixer can be used to disperse the electric charge generation material.

The amount of the electric charge generation material is preferably 1 through 600 parts by weight of the electric charge generation material, more preferably 50 through 500, with respect to 100 parts by weight of binder resin. The film thickness of the electric charge generation layer differs according to the characteristics of the electric charge generation material and binder resin and percentage of mixture, and is preferably 0.01 through 5 μm, more preferably 0.05 through 3 μm. An image defect can be prevented from occurring by filtering out the foreign substances and coagulants before applying the coating composition for the electric charge generation layer. It can be formed by vacuum evaporation coating of the aforementioned pigment.

Electric Charge Transport Layer

The electric charge transport layer used in the photosensitive layer contains an electric charge transport material and binder resin, and is formed by dissolving the electric charge transport material in the binder resin and coating the same.

The electric charge transport material is exemplified by carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compound, hydrazone compound, pyrazoline compound, oxazolone derivatives, benzimidazole derivatives, quinazoline derivatives, benzofuran derivatives, acridine derivatives, phenazine derivatives, aminostilbene derivatives, triarylamine derivatives, phenylene diamine derivatives, stilbene derivatives, benzidine derivatives, poly-N-vinyl carbazole, poly-1-vinyl pyrene, and poly-9-vinyl anthracene. Two or more of these substances can be mixed for use.

It is preferable to use an electric charge transport material having an atomic ratio of a nitrogen atom being not less than 4.5% as the electric charge transport material (CTM). The electric charge transport material having a fundamental structure of a triphenylamine derivative, a styryl compound, a benzidine compound, a butadiene compound and so on, may be used. The styryl compound is preferable among them.

The conventional resin can be used as the binder resin for the electric charge transport layer. The examples include polycarbonate resin, polyacrylate resin, polyester resin, polystyrene resin, styrene-acrylonitrile copolymer resin, polymethacrylate ester resin, and styrene-methacrylate ester copolymer Polycarbonate is preferably used. Further, BPA (Bisphenol A), BPZ, dimethyl BPA, and BPA-dimethyl BPA copolymers are preferably used because of excellent resistance to cracks and abrasion, and excellent antistatic performances.

The electric charge transport layer is preferably formed by dissolving binder resin and an electric charge transport material to prepare a coating composition, which is then applied to the layer to a predetermined thickness, and then the coating film is dried.

The examples of the solvent for dissolving the binder resin and electric charge transport materials include toluene, xylene, methylene chloride, 1,2-dichloroethane, methyl ethyl ketone, cyclohexanone, ethyl acetate, butyl acetate, methanol, ethanol, propanol, butanol, tetrahydrofuran, 1,4-dioxane, 1,3-dioxolane, pyridine, and diethyl amine, without being restricted thereto.

The amount of the electric charge transport material is preferably in the range of 10 through 500 parts by weight of electric charge transport material, more preferably in the range of 20 through 100 parts by weight, with respect to 100 parts by weight of binder resin.

The thickness of the electric charge transport layer varies according to the characteristics of the electric charge transport material and binder resin, and percentage of mixture, and is preferably 5 through 40 μm, more preferably 10 through 30 μm.

An antioxidant, electronic conductive agent, and stabilizer can be applied to the electric charge transport layer. The antioxidants listed in JP-A 2000-305291, and electronic conductive agents listed in JP-A S50-137543 and S58-76483 are preferably used.

A latent image formed on the photoreceptor is visualized to a toner image via development. The toner used in the development includes pulverized toner or polymerization toner, and polymerization toner is preferable because stable particle size distribution is obtained.

In the polymerization toner, preparation of binder resin for the toner and the shape of toner particles are formed by a polymerization of monomer of the binder resin material and, if necessary, a chemical process thereafter. Practically, the toner is prepared by polymerization such as suspension polymerization or emulsion polymerization and a process of fusing particles after the polymerization.

Volume average particle diameter of the toner, i.e. 50%) volume particle (Dv50), is preferably 2 to 9 μm, and more preferably 3 to 7 μm. High resolution of the image is obtained by employing toner having such particle size distribution condition. Further, the toner can be composed of reduced content of minute particle size though the toner is small particle size toner, and color reproduction of dot image is improved for long time and toner image having good sharpness and stability can be obtained.

Developer

The toner of the present invention can be used in the form of a one-component developer and two-component developer.

The one-component developer to be used includes the non-magnetic one-component developer and the magnetic one-component developer formed by about 0.1 through 0.5 μm of magnetic particles contained in the toner. Both of them can be used.

The developer can be mixed with a carrier and can be used as a two-component developer. Examples of the carrier are conventional magnetic particles as exemplified by metals such as iron, ferrite and magnetite, and alloys between these metals and such metals as aluminum. Use of the ferrite particles is preferred in particular. The particle size of the aforementioned carrier is preferably 15 through 100 μm in terms of mass-average particle size, more preferably 25 through 80 μm.

The carrier particle size can be measured typically by the laser diffraction type particle size distribution measuring instrument "Helos" (by Sympatec Inc.).

The preferred carrier is the one whose magnetic particles are coated further with resin, or the so-called resin dispersed carrier wherein magnetic particles are dispersed in resin. There is no particular restriction to the type of the resin for coating. For example, olefin resin, styrene resin, styrene-acrylic resin, silicone resin, ester resin, or fluorine-containing polymer resin are often used. Further, there is no particular restriction to the type of the resins for constituting the resin dispersed carrier. The conventionally known resins can be used. Examples are styrene-acrylic resin, polyester resin, fluorine resin, and phenol resin. The carrier coated with styrene-acrylic resin out of these examples is preferably used because of the excellent performances in preventing the external additive agent from being separated, or in enhancing durability.

An image forming apparatus to which the organic photoreceptor of the present invention may be applied is described.

The image forming apparatus 1 shown in FIG. 1 is a digital type image forming apparatus, and is structured by an image reading section A, image processing section B (not shown), image forming section C, and transfer sheet conveyance section D.

An automatic document feeding unit to automatically convey documents is provided on the upper portion of the image reading section A, and the documents placed on a document placement board 11 is separated one by one sheet and conveyed by a document conveyance roller 12, and an image is read at a reading position 13*a*. The document, after reading is completed, is delivered by the document conveyance roller 12 onto a document sheet delivery tray 14.

An image of the document when it is placed on a platen glass 13, is read out by a reading operation at a speed of v of the first mirror unit 15 which is composed of an illumination lamp and the first mirror, and by a moving exposure at a speed of v/2 of the second mirror unit 16 in the same direction which is composed of the second mirror and the third mirror, which are positioned in V-letter shape, wherein the first mirror unit 15 and the second mirror unit constitute a scanning optical system.

The read image is formed on the light receiving surface of an image pick-up element CCD, which is a line sensor, through a projection lens 17. A line-shaped optical image formed on the image pick-up element CCD is successively electro-optical converted into electrical signal (brightness signal), then A/D converted, and after processing such as density conversion, filter processing, or the like, is conducted in an image processing section B, the image data is temporarily stored in a memory.

In the image forming section C, as image forming units, around the outer periphery of a drum-like photoreceptor 21, a charger 22 to charge on the photoreceptor, a potential detecting device 220 to detect the potential on the photoreceptor, a developing unit 23, a transfer belt 45, a cleaning unit 26 cleaning the photoreceptor, and pre-charge lamp (PCL) 27 eliminating potential by light on the photoreceptor are respectively arranged in the order of operation. A reflective density meter 222, which measures reflective density of developed patch image, is equipped on the photoreceptor at the down stream of the developer 23. The photoreceptor drum 21 according to this invention is rotated clockwise in the drawing.

After uniform charging by the charger 22 is conducted on the rotating the photoreceptor 21, image exposure is conducted by the exposure optical system 30 according to an image signal read from the memory of the image processing section B. The exposure optical system 30, which is a writing unit, uses a laser diode, not shown in the drawing, as a light emitting source, and an optical path is changed by a reflection mirror 32 through a rotating polygonal mirror 31, fθ lens 34, and cylindrical lens 35, and the primary scanning is conducted. The image exposure is conducted at position Ao on the photoreceptor drum 21, and a latent image is formed by the rotation (the subsidiary scanning) of the photoreceptor drum 21. In the present example, exposure is conducted on a portion having characters and a reversal latent image is formed.

A semiconductor laser or an emission diode having oscillation wave length of 350-800 nm is employed for image exposure to form a latent image on the photoreceptor in this invention. An electrophotographic image having 400-2,500 dpi high definition can be obtained by employing these exposing light source with exposing laser light beam spot of 10-100 μm in the primary scanning direction and exposing digitally.

The laser light beam spot is a radius of a length of exposing beam (Ld) measured at the maximum position along with a primary scanning direction in an area having exposing intensity of more than $1/e^2$ times of peak intensity of the exposing light beam.

Image exposure is conducted by light beam employing a scanning optical system such as semiconductor laser, and a solid scanner such as LED and liquid crystal shutter. The light beam intensity distribution includes Gaussian, Lorentzian and so on, in any which the light beam spot mentioned above may be applied.

The latent image on the photoreceptor drum 21 is reversal-developed by the developing unit 23, and a visual image by a toner is formed on a surface of the photoreceptor drum 21.

In the transfer sheet conveyance section D, sheet feed units 41(A), 41(B), and 41(C) in which different sized transfer sheet P are accommodated, are provided in the lower portion of the image forming unit, and on the side portion, a manual sheet feed unit 42 to conduct the manual sheet feed is provided, and the transfer sheet selected from any one of these sheet feed units, is fed along a sheet feed path 40 by a guiding roller 43. The transfer sheet P is temporarily stopped and then fed by the register roller 44 by which inclination and deflection of the feeding transfer sheet are corrected, and through a sheet feed path 40, a pre-transfer roller 43*a*, a paper providing pass 46 and entrance guide plate 47, the toner image on the photoreceptor drum 21 is transferred onto the transfer sheet P at the transfer position Bo by the transfer unit 24, next, the transfer sheet P is discharged by the separation unit 25 and separated from the photoreceptor drum 21 surface, and conveyed to the fixing unit 50 by the conveyance apparatus 45.

The fixing unit 50 has a fixing roller 51 and a pressure roller 52, and the transfer sheet passes between the fixing roller 51 and the pressure roller 52, thereby, toner is fused by heat and pressure. On the transfer sheet P on one side of which the toner image has been fixed, two-sided image formation, by which the toner image is formed also on the other side of the transfer sheet, is conducted according to a mode, which will be described below, or on the condition that the image is formed on only one side of the transfer sheet, the transfer sheet is delivered onto the sheet delivery tray 64.

The situation for image forming on one side of the image receiving sheet is described above. When the copies are made on both sides of the sheet, the paper outputting course changing member 170 is switched so that the image receiving paper guiding member 177 is opened and the image receiving paper P is conveyed in the direction of the broken arrow.

The image receiving paper P is conveyed to the lower direction by a conveying mechanism 178 and switch-backed, so as to become the tail of the paper to top, and guided into a paper supplying unit for double-face copying 130.

The image receiving paper P is conveyed to paper supplying direction on the conveying guide 131 provided in the paper supplying unit for double-face copying 130 and re-supplied by the paper supplying roller 132 and guided to the conveying course 40.

The image receiving paper P is conveyed to the photoreceptor 21 as above-mentioned and a toner image is transferred onto the back side of the image receiving paper P, and output onto the paper output tray 64 after fixing the toner image by the fixing unit 50.

In the image forming method according to the invention, the photoreceptor and another constituting member such as the developing unit and the cleaning unit may be combined as a unit of a processing cartridge which can be freely installed to and released from the main body of the apparatus. Besides, at least one of the charging unit, imagewise exposing unit, developing unit, transferring or separating unit and cleaning unit may be unitized with the photoreceptor to form a processing cartridge which is able to be freely installed to or released from the main body of the apparatus using a guiding means such as a rail.

Figure 2:
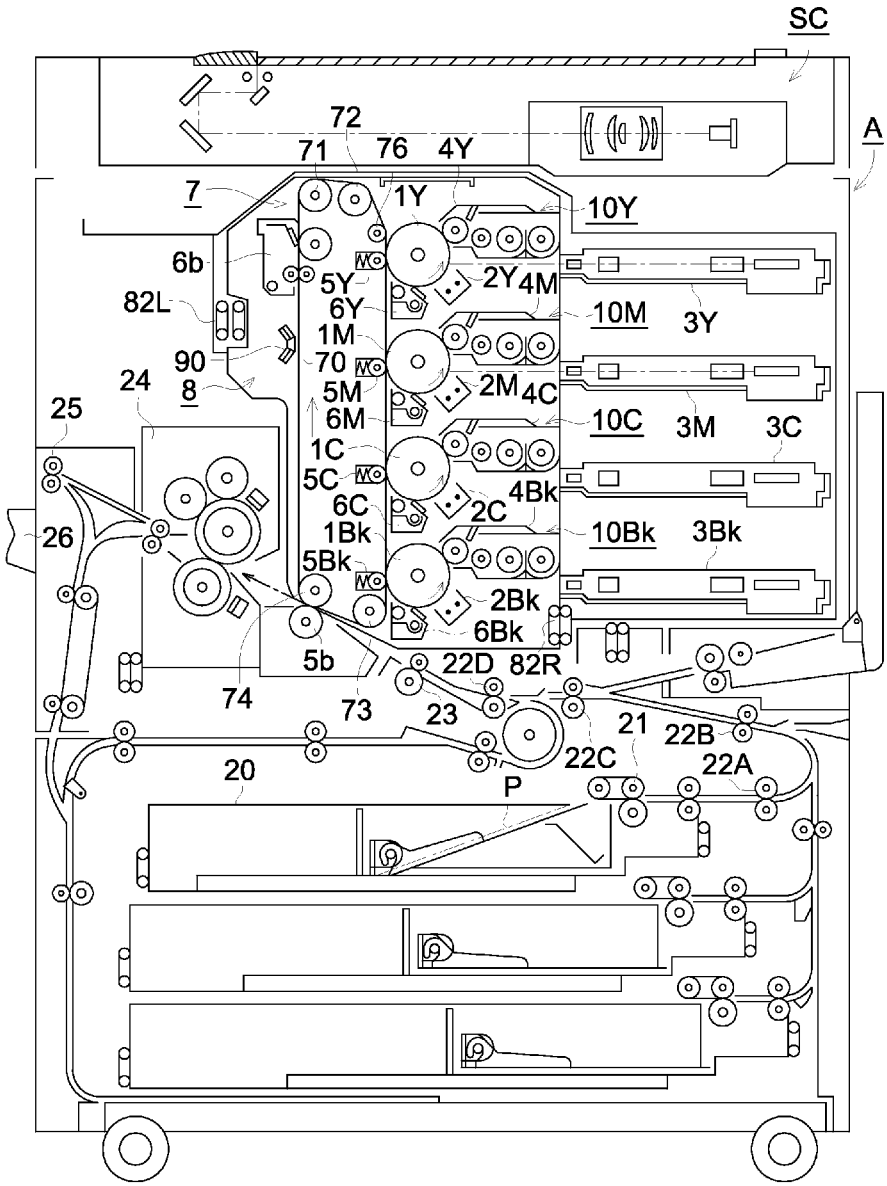
FIG. 2: A schematic view of another image forming apparatus in which the photoreceptor of the present invention is applied.

FIG. 2 is a schematic view of an example of a color image forming apparatus.

The color image forming apparatus is one so called as a tandem type color image forming apparatus, in which four image forming units 10Y, 10M, 10C and 10B*k*, an endless belt-shaped intermediate transferring unit 7, a paper conveying unit 21 and a fixing unit 24 are equipped. An original image reading unit SC is arranged at the upper portion of the main body of the image forming apparatus.

The image forming unit 10Y for forming a yellow colored image has a drum-shaped photoreceptor 1Y as a primary image carrier, and a charging unit 2Y, exposing unit 3Y, developing unit 4Y, a primary transferring roller 5Y as a primary transferring unit and a cleaning unit 6Y which are arranged around the photoreceptor 1Y. The image forming unit 10M for forming a magenta colored image has a drum-shaped photoreceptor 1M, and a charging unit 2M, exposing unit 3M, developing unit 4M, a primary transferring roller 5M as a primary transferring unit and a cleaning unit 6M. The image forming unit 10C for forming a cyan colored image has a drum-shaped photoreceptor 1C, and a charging unit 2C, exposing unit 3C, developing unit 4C, a primary transferring roller 5C as a primary transferring unit and a cleaning unit 6C. The image forming unit 10B*k* for forming a black colored image has a drum-shaped photoreceptor 1B*k*, and a charging unit 2B*k*, exposing unit 3B*k*, developing unit 4B*k*, a primary transferring roller 5B*k* as a primary transferring unit and a cleaning unit 6B*k*.

The four image forming units 10Y, 10M, 10C and 10B*k* are composed of rotating charge unit 2Y, 2M, 2C and 2BK, image exposing unit 3Y, 3M, 23C and 3BK, rotating developing unit 4Y, 4M, 4C and 4BK, and cleaning unit 5Y, 5M, 5C and 5BK, each cleaning the photoreceptor drums 1Y, 1M, 1C and 1BK, around the photoreceptor drums 1Y, 1M, 1C and 1BK.

The image forming units 10Y, 10M, 10C and 10B*k* are similar except that the color of toner image formed on the photoreceptors 1Y, 1M, 1C and 1BK are different, and therefore, the description is detailed representatively taking the image forming unit 10Y.

The image forming units 10Y is composed of charging unit 2Y, exposing unit 3Y, developing unit 4Y and cleaning unit 5Y arranged around a photoreceptor drum 1Y, to form yellow toner image on the photoreceptor drum 1Y. At least the photoreceptor drum 1Y, charging unit 2Y, developing unit 4Y and cleaning unit 5Y are provided integrally among the image forming unit 10Y in one of the embodiment according to this invention.

The charging unit 2Y gives uniform charge to the photoreceptor drum 1Y, and a corona discharge type charger 2Y is provided for the photoreceptor drum 1Y.

The image exposure unit 3Y exposes light according to yellow image signal to the photoreceptor 1Y, on which uniform charge has been given by charger 2Y, so as to form a latent image corresponding to the yellow image. Examples of the exposure unit include one composed of LED array emission elements and image forming elements such as SELFOC lens, arranged around the axis of the photoreceptor, and a laser optical system.

The present electrophotographic image forming apparatus is constituted in such a manner that components such as the photoreceptor, development unit, cleaning unit the like are integrated as a cartridge, and this unit may be detachable from the main frame. Further, the process cartridge may be formed as a single detachable unit in such a manner that at least one of a charging unit, an image exposure unit, a development unit, a transfer or separation unit, and a cleaning unit is integrated with a photoreceptor, and it may be arranged to be detachable employing an guiding means such as a rail in the apparatus main frame.

The endless belt-shaped intermediate transferring unit 7 has a semiconductive endless belt-shaped transferring member 70 as a secondary image carrier which is wound on plural rollers and circulatably held.

Color images formed in the image forming units 10Y, 10M, 10C and 10B*k*, respectively, are successively transferred onto the circulating endless belt-shaped intermediate transferring member 70 by the primary transferring rollers 5Y, 5M, 5C and 5B*k* as the primary transferring unit, thus a color image is synthesized. Paper P as a recording material (a support carrying the finally fixed image such as a plain paper sheet and a transparent sheet) stocked in a paper supplying cassette 20 is supplied by a paper supplying unit 21, and conveyed to a secondary transferring roller 5A as a secondary transferring means through intermediate conveying rollers 22A, 22B, 22C and 22D and a register roller 23. Then the color image is collectively transferred by the secondary transferring onto the paper P. The color image transferred on the paper P is fixed by the fixing unit 24 and conveyed by an output roller 25 to be stood on an output tray 26.

Besides, the toner remained on the endless belt intermediate transferring member 70 is removed by the cleaning unit 6A after the color image is transferred to the paper P by the secondary transferring roller 5A and the paper P is separated by curvature from the intermediate transferring belt.

In the course of the image formation process, the primary transferring roller 5B*k* is constantly pressed to the photoreceptor 1B*k*. The other primary transferring rollers 5Y, 5M and 5C are each contacted by pressing to the corresponding photoreceptors 1Y, 1M and 1C, respectively, only for the period of image formation.

The secondary transferring roller 5*b* is contacted by pressing to the endless belt-shaped intermediate transferring member 70 only for the period of the secondary transferring while passing of the paper P.

A frame 8 can be pulled out from the main body A of the apparatus through supporting rails 82L and 82R.

The frame 8 includes the image forming units 10Y, 10M, 10C and 10B*k*, and an intermediate transferring unit 7 comprising the intermediate transferring member 70.

The image forming units 10Y, 10M, 10C and 10B*k* are serially arranged in the perpendicular direction. In the drawing, the endless belt-shaped intermediate transferring unit 7 is arranged at left side of the photoreceptors 1Y, 1M, 1C and 1B*k*. The endless belt-shaped intermediate transferring unit 7 included the circulatable endless belt-shaped intermediate transferring member 70 wound with the rollers 71, 72, 73 and 74, the primary transferring rollers 5Y, 5M, 5C and 5B*k*, and the cleaning unit 6*b*.

Figure 3:
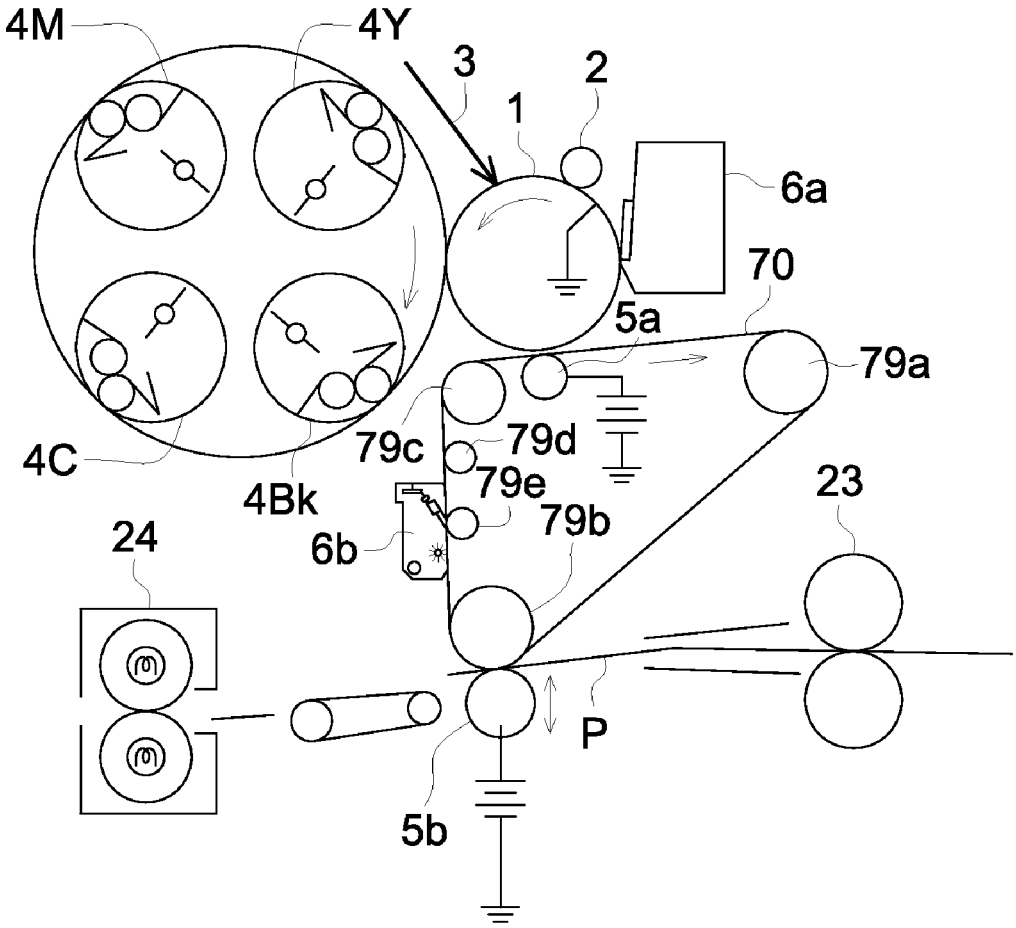
FIG. 3: A schematic view of the other image forming apparatus in which the photoreceptor of the present invention is applied.

FIG. 3 shows a cross section of a color image forming apparatus employing an organic photoreceptor according to this invention (a copy machine or a laser beam printer having at least an organic photoreceptor and around thereof a charging unit, an exposing unit, a plurality of developing unit, a cleaning unit and an intermediate transferring member). An elastic material having an intermediate electric resistance is used for the intermediate transferring member 70.

The symbol 1 indicates a rotation drum type photoreceptor repeatedly usable as the image forming member, which is anticlockwise rotated at a designated circumference rate.

In the course of the rotation, the photoreceptor 1 is uniformly charged at a designated polarity and electrical potential by a charging unit 2 and then imagewise exposed by scanning by a laser beam modulated by time serial electric digital signals of image information by a imagewise light exposing unit 3, so that an electrostatic latent image corresponding to a yellow (Y) color component of an objective color image is formed.

After that, the electrostatic latent image is developed by a yellow color developing unit 4Y employing a yellow toner as a first color. On this occasion, actions of second through fourth developing unit (a magenta color developing unit, cyan color developing unit and black color developing unit) 4M, 4C and 4B*k* are turned off and these developing unit do not affect to the photoreceptor 1 so that the yellow toner image as the first color is not influenced by the second through fourth developing units.

The intermediate transfer member 70 is suspended by rollers 79*a*, 79*b*, 79*c*, 79*d* and 79*e* and driven so as to be clockwise rotated in a circumference rate the same as that of the photoreceptor 1.

The first color of the yellow color image carried on the photoreceptor 1 is successively transferred (primary transfer) onto the outer surface of the intermediate transfer member 70 by primary transfer bias applied to the intermediate transfer member 70 from the primary transferring roller 5*a*.

After the transfer of the yellow color toner image as the first color, the surface of the photoreceptor 1 was cleaned by a cleaning unit 6*a*.

In the similar manner, a magenta toner image as the second color, cyan toner image as the third color and black toner image are successively transferred onto the intermediate transfer member 70 in pile to form the piled color toner image corresponding to the objective color image.

A secondary transfer roller 5*b* is releasably arranged so as to be faced to the lower surface of the intermediate in parallel with a secondary transfer counter roller 79*b*.

The primary bias for successively transferring the toner images of the first to fourth colors is reversal in the polarity to that of the toner and is applied from a bias power source. The applying voltage of it is, for example, within the range of from +100V to +2 kV.

In the primary transferring process of the first to third color toner images from the photoreceptor 1 to the intermediate transfer member 70, the secondary transferring roller 5*b* and the intermediate transfer member cleaning unit 6*b* can be released from the intermediate transferring member 70.

In the course of the transfer of the piled color toner image transferred onto the belt-shaped intermediate transfer member 70 to the image receiving material P as a secondary image carrier, the secondary transferring roller 5*b* is contacted to the belt of the intermediate transfer member 70, at the same time the image receiving material P is supplied on designated timing by a pare of paper supplying resist rollers 23 through an image receiving paper guide to the contacting nip of the intermediate transfer member 70 with the secondary transfer roller 5*b*. The secondary bias is applied from a bias power source to the secondary transfer roller 5*b*. The piled color toner image is transferred to the intermediate transfer member 70 to the image receiving material P as the second image carrier (secondary transfer) by the secondary transferring bias. The image receiving material P, on which the toner image is received, is introduced into a fixing unit 24 and thermally fixed.

The organic photoreceptor of the present invention is applicable to such an electrophotographic apparatus in general as an electrophotographic copying machine, laser printer, LED printer and liquid crystal shutter type printer. Further, it is also applicable over a wide range to a display, recorder, light printer, prepressing machine and facsimile machine that are based on electrophotographic technology.

EXAMPLES

The invention is illustrated by means Examples. The term "parts" means parts by weight.

Photoreceptor 1

The photoreceptor 1 was produced as follows.

The cylinder type aluminum base support having machine surface was prepared, which surface has surface roughness Rz of 1.5 μm, having outer diameter of 80 mm and length of 362 mm.

<Inter Layer>

Coating composition of the inter layer formulated as below was prepared.

| | |
|---|---|
| Polyamide resin X1010, manufactured by Daicel-Degussa Ltd. | 1 part |
| Γ-alumina SMT500SAS, manufactured by TAYCA CORPORATION | 1.1 parts |
| Ethanol | 20 parts |

The composition was dispersed in batch process for ten hours employing a sand mill dispersion apparatus.

The coating composition was applied on to the support by dipping and thereafter drying at 110° C. for 20 minutes so as to obtain an interlayer having dry thickness of 2 μm.

<Charge Generation Layer>

The following components were mixed and dispersed by a sand mill for ten hours to prepare a coating composition for charge generation layer.

| | |
|---|---|
| Charge generation material, Titanyl phthalocyanine pigment, having a maximum peak at 27.3° based on a Cu—Kα characteristic X-ray diffraction spectrum measurement | 20 part |
| Polyvinylbutyral resin (#6000-C, manufactured by Denkikagaku Kogyo Kabushiki Kaisha) | 10 parts |
| t-Butyl acetate | 700 parts |
| 4-Methoxy-4-methyl-2-pentanone | 300 parts |

The coating composition was coated on the interlayer by dipping method to form a charge generation layer having dry thickness of 0.3 μm.

<Charge Transporting Layer>

| | |
|---|---|
| Charge transporting material (shown below) | 150 parts |
| Binder, Polycarbonate (Z300: manufactured by Mitsubishi Gas Chemical Company, Inc.) | 300 parts |
| Anti-oxidant (IRGANOX 1010, manufactured by Nihon Ciba Geigy K.K.) | 6 parts |
| Toluene/tetrahydrofuran: 1/9 vol % | 2,000 parts |
| Silicone oil (KF-54: manufactured by Shin-Etsu Chemical Co., Ltd.) | 1 part |

The above listed compositions were mixed and dissolved to prepare a coating composition for charge transport layer, that was coated on the charge generation layer by dip coat method and dried for 60 minutes at 110° C. to form a charge transport layer having dry thickness of 20 μm.

Compound A

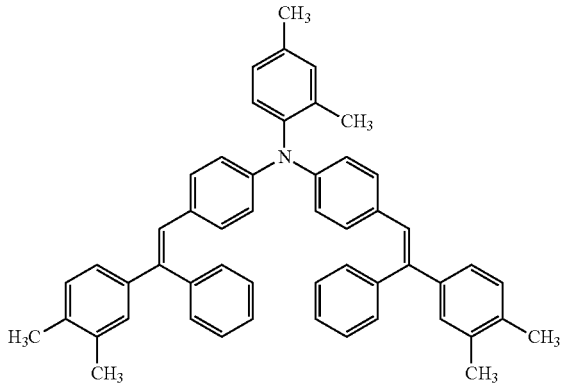

<Protective Layer>

| | |
|---|---|
| Alumina particles surface treated by a compound a reactive organic group (γ-alumina particles having a number average 50% particle diameter of 31 nm, having been subjected to surface treatment with the same amount of methacryloxypropyltrimethoxysilane) | 100 parts |
| Hardenable Compound (Exemplified compound No. 31) | 100 parts |
| Isopropyl alcohol | 500 parts |
| The above listed compounds were dispersed for ten hours employing sand mill, then polymerization initiator 1-6 | 30 parts |

was added and mixed under light shielded condition to prepare a coating composition for the protective layer. It was stored under light shielded condition. The coating composition was coated on the charge transport layer employing circular shape slide hopper to form the protective layer. It was dried for 20 minutes at room temperature to remove solvent, then UV ray was exposed by employing metal halide lamp of 500 W with distance of 100 mm for 1 minute during the photoreceptor is rotating to harden the layer. A protective layer having thickness of 3 μm was formed.

Preparation of Photoreceptors 2 through 15

Photoreceptors 2 through 15 were prepared in the same manner as the photoreceptor 1 except that the materials used for the protective layer and hardening condition of the protective layer were modified shown in Table 1.

Hardening condition by light: Exposing the photoreceptor to UV ray by employing metal halide lamp of 500 W with distance of 100 mm for 1 minute during the photoreceptor is rotating, to form protective layer having thickness of 3 μm.

Hardening condition by heat: Heating for 30 minutes at 140° C. to form protective layer having thickness of 3 μm.

Photoreceptor 16

Photoreceptor 16 was prepared in the same manner as the Photoreceptor 1, except that the alumina particles were not used in the protective layer.

Photoreceptor 17

Photoreceptor 17 was prepared in the same manner as the Photoreceptor 1, except that the surface treating agent was replaced by isobutyl trimethoxysilane (surface treating agent having no reactive functional group), and polyarylate was used for a binder of the protective layer.

Photoreceptor 18

Photoreceptor 18 was prepared in the same manner as the Photoreceptor 1, except that the surface treating agent was replaced by isobutyl trimethoxysilane (surface treating agent having no reactive functional group).

Photoreceptor 19

Photoreceptor 19 was prepared in the same manner as the Photoreceptor 1, except that γ-alumina particles were replaced by trigonal α-alumina particles in the protective layer.

TABLE 1

| | Alumina particles | | | | Hardenable compound | | | Initiator | | |
|---|---|---|---|---|---|---|---|---|---|---|
| No. | Kinds of alumina | Particle diameter** (nm) | *** | Ratio**** | Exemplified compound | Parts | Ac Number | Exemplified compound | Parts | Hardening method |
| 1 | γ-alumina (1) | 31 | S-15 | 100/100 | 31 | 100 | 4 | 1-6 | 30 | Light |
| 2 | γ-alumina (1) | 10 | S-5 | 100/100 | 7 | 100 | 6 | 1-6 | 30 | Light |
| 3 | γ-alumina (1) | 100 | S-13 | 100/100 | 1 | 100 | 3 | 1-6 | 30 | Light |
| 4 | γ-alumina (1) | 31 | S-15 | 15/200 | 42 | 100 | 3 | 1-6 | 30 | Light |
| 5 | γ-alumina (1) | 31 | S-1 | 15/200 | 42 | 100 | 3 | 1-6 | 30 | Light |
| 6 | γ-alumina (1) | 31 | S-7 | 100/150 | 31 | 100 | 4 | 1-6 | 30 | Light |
| 7 | γ-alumina (1) | 31 | S-8 | 100/100 | 31 | 100 | 4 | 5-1 | 30 | Heat |
| 8 | γ-alumina (1) | 5 | S-15 | 100/100 | 9 | 100 | 6 | 5-1 | 30 | Heat |
| 9 | γ-alumina (1) | 60 | S-26 | 30/150 | 42 | 100 | 3 | 1-6 | 30 | Light |
| 10 | γ-alumina (1) | 100 | S-22 | 50/300 | 42 | 100 | 3 | 1-6 | 30 | Light |
| 11 | γ-alumina (1) | 120 | S-16 | 100/300 | 42 | 100 | 3 | 1-6 | 15 | Light |
| 12 | γ-alumina (1) | 200 | S-15 | 100/100 | 31 | 100 | 4 | 1-6 | 30 | Light |
| 13 | γ-alumina (1) | 31 | S-15 | 100/70 | 31 | 100 | 4 | 1-6 | 30 | Light |
| 14 | γ-alumina (2) | 31 | S-15 | 100/100 | 31 | 100 | 4 | 1-6 | 30 | Light |
| 15 | γ-alumina (3) | 31 | S-15 | 100/100 | 31 | 100 | 4 | 1-6 | 30 | Light |
| 16 | None | — | — | — | 31 | 100 | 4 | 1-6 | 30 | Light |
| 17 | γ-alumina (1) | 31 | *A | — | Polyarylate | 100 | — | — | — | — |
| 18 | γ-alumina (1) | 31 | *A | 100/100 | 31 | 100 | 4 | 1-6 | 30 | Light |
| 19 | α-alumina | 140 | S-15 | 100/100 | 31 | 100 | 4 | 1-6 | 30 | Light |

*A: :Isobutyltrimethoxy silane

**Number average 50% particle diameter

***: Surface treating agent

****Ratio of surface treating agent/inorganic particles (parts by parts)

In Table 1, the following γ-alumina particles were used.

γ-alumina (1): γ-alumina containing almost no other crystal system of alumina

γ-alumina (2): γ-alumina containing 20 weight % δ-alumina

γ-alumina (3): γ-alumina containing 25 weight % δ-alumina and 10 weight % θ-alumina Evaluation of Photoreceptor Scratches on the Surface The photoreceptors were tested in the following ways.

The photoreceptor was mounted on image forming apparatus "bizhub PRO C6500" (produced by Konica Minolta Business Technologies Inc., Tandem type color multifunction apparatus with laser exposure, reversal developing and intermediate transfer) modified so as to conduct evaluation and optimize exposing amount. The test photoreceptor was amounted at cyan image forming unit. Scratches on the surface of the test photoreceptor was observed after printing on neutral paper of 1,000,000 sheets of A4 image having each of yellow, magenta cyan and black of a pixel ratio of 2.5% was successively carried out at 20° C., 50% RH.

A: No scratch was observed after 1,000,000 sheets printing. (Good)

B: One to ten scratches were observed after 1,000,000 sheets printing. (Practically acceptable)

C: Eleven or more scratches were observed after 1,000,000 sheets printing. (Practically not acceptable)

Wastage Thickness

Abrasion was evaluated by reduction of layer thickness after 1,000,000 sheets as described above. Thickness of the photoreceptor at 10 points at uniform thickness portion were randomly measured (excluding 3 cm end portion, where thickness may not be uniform), and the average of them was referred to the thickness of the photoreceptor. Thickness was measured by an eddy current type instrument EDDY650C manufactured by Helmut Fischer GMBTE CO. Difference of the thickness before and after printing was recorded as the wastage thickness.

A: Wastage thickness is not more than 1 μm. (Good)

B: Wastage thickness is not more than 1 μm to not more than 3 μm. (Practically acceptable)

C: Wastage thickness is more than 3 μm. (Practically not acceptable)

Black Spots (BS)

Occurrence of black spots on the half tone image was judged by the following criteria.

A: No black spots nucleus on the photoreceptor was observed, and no black spot on the halftone image was observed. (Good)

B: Black spots nucleus on the photoreceptor was observed, but no black spot on the half tone image was observed. (Practically acceptable)

C: Black spots nucleus on the photoreceptor was observed, and black spots on the half tone image were observed. (Practically not acceptable)

Cleaning Performance

Ten sheets printing of A3 size paper was conducted continuously after 100,000 sheets printing and 200,000 sheets printing, respectively, occurrence of fog due to passing through of toner at white area without image forming on the recording paper was observed. The cleaning performance was evaluated by a degree of passing through of toner.

Evaluation Criteria

A: No toner passing through was observed up to 200,000 sheets printing. Good cleaning performance.

B: No toner passing through was observed up to 100,000 sheets printing. Practically acceptable performance.

C: Toner passing through was observed not more than 100,000 sheets printing. Practically not acceptable performance.

Image Blur

Printing test was conducted in the same way as the test of scratches on the surface except that the printing environment was changed at 30° C. and 80% RH, and prints was made on 25,000 sheets of neutral A4 paper, and main power supply was turned off 60 seconds after printing. The power supply was turn on 12 hours thereafter, and an image having half tone image having relative density 0.4 measured by Macbeth reflective densitometer on whole area of A3 paper and an image having 6 dot grid image on whole area of A3 paper were printed out on neutral A3 size paper just after the printing became available. Printed image were observed and evaluated as described below.

A: No blur was observed both in half tone image or grid image. (Good)

B: Light web like density depression along with long axis of the photoreceptor only in half tone image. (Practically acceptable)

C: Defects or line depression in grid image due to image blur was observed. (Practically not acceptable)

The result is summarized in Table 2.

TABLE 2

| Photo-receptor No. | Evaluation | | | | |
|---|---|---|---|---|---|
| | Scratches | Wastage | Black Spots | Cleaning performance | Image blur |
| 1 | A | A | A | A | B |
| 2 | A | A | A | A | B |
| 3 | A | A | A | A | B |
| 4 | A | A | A | A | A |
| 5 | A | A | A | A | A |
| 6 | A | A | A | A | B |
| 7 | B | A | A | B | B |
| 8 | B | A | A | B | A |
| 9 | B | A | A | B | B |
| 10 | A | A | A | A | A |
| 11 | A | A | A | A | A |
| 12 | A | A | A | A | A |
| 13 | A | A | A | A | B |
| 14 | A | A | A | A | B |
| 15 | A | A | A | A | B |
| 16 | C | C | C | B | B |
| 17 | B | C | C | C | B |
| 18 | B | C | C | B | B |
| 19 | B | B | C | B | C |

The photoreceptors 1-15 according to this invention are evaluated as good or practically acceptable in each evaluation item. Comparative photoreceptors 16-19 are evaluated as practically not acceptable in at least one item.

The invention claimed is:

1. An organic photoreceptor comprising a photosensitive layer and a protective layer, provided on an electric conductive support, wherein the protective layer comprises a composition obtained by hardening reaction of γ-alumina particles surface treated with a compound having a reactive functional group with a hardenable compound.

2. The organic photoreceptor of claim 1 wherein the compound having a reactive functional group is a compound having a carbon-carbon double bond and a silyl group.

3. The organic photoreceptor of claim, 1 wherein the hard enable compound is a compound having a carbon-carbon double bond.

4. The organic photoreceptor of claim 3, wherein the hard enable compound is selected from the group consisting of a styrene monomer, an acryl monomer, a meth acryl monomer, a vinyl toluene monomer, vinyl acetate monomer and N-vinyl pyrrolidone monomer.

5. The organic photoreceptor of claim 4, wherein the hardenable compound is a compound having an acryloyl or methacryloyl group.

6. The organic photoreceptor of claim 5, wherein the hardenable compound is a compound having two or more acryloyl or methacryloyl groups.

7. The organic photoreceptor of claim 6, wherein the hardenable compound is a compound having two to six acryloyl or methacryloyl groups.

8. The organic photoreceptor of claim 1, wherein a number based 50% particle diameter of the γ-alumlna particles is 5 to 200 nm.

9. The organic photoreceptor of claim 4, wherein the compound having an acryloyl or methacryloyl group has M/Ac of 1,000 or less, wherein Ac and M are a number of acryloyl or methaoryloyl groups and molecular weight of the compound, respectively.

10. The organic photoreceptor of claim 9, wherein the compound having an acryloyl or methacryloyl group has M/Ac of 500 or less.

11. The organic photoreceptor of claim 9, wherein the compound having a reactive functional group is a compound represented by Formula (1), Formula (1)

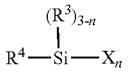

wherein $R^3$ is an alkyl having carbon atoms of from 1 to 10 or an aralkyl having carbon atoms of from 1 to 10, $R^4$ is an organic group having polymerizable double bond, X is a halogen atom, an alkoxy, acyloxy, amanooxy or phenoxy group, and n is an integer of from 1 to 3.

12. The organic photoreceptor of claim 4, wherein the hardenable compound is a compound having a methacryloyl group.

13. The organic photoreceptor of claim 1, wherein a content of the γ-alumina particles is 1 to 300 parts by weight with reference to 100 parts by weight of the hardenable compound.

14. The organic photoreceptor of claim 13, wherein a content of the γ-alumina particles is 80-200 parts by weight with reference to 100 parts by weight of the hardenable compound.

15. The organic photoreceptor of claim 1, wherein the coated composition is hardened via an actinic ray irradiation or heating.

16. The organic photoreceptor of claim 15, wherein the coated composition is hardened via UV irradiation.

17. The organic photoreceotor of claim 1, wherein a thickness of the protective layer is 0.2 through 10μm.

18. The organic photoreceptor of claim 17, wherein a thickness of the protective layer is 0.5 through 6μm.

19. A manufacturing method of an organic photoreceptor comprising, a photosensitive layer and a protective layer, provided on an electric conductive support, wherein the protective layer is formed by steps comprising;

surface treating γ-alumina particles with a compound having a reactive functional group, preparing a coating composition comprising the treated γ-alumina particles and a hardenable compound, coating the coating composition on the photosensitive layer, and hardening the coated composition.

* * * * *